US007722449B2

(12) United States Patent
Nowak et al.

(10) Patent No.: US 7,722,449 B2
(45) Date of Patent: May 25, 2010

(54) AIR CHANNEL GRILL FOR SECURITY INSTITUTIONS

(75) Inventors: J. Paul Nowak, Winnipeg (CA); James Fehr, Winnipeg (CA)

(73) Assignee: E.H. Price, Limited, Winnipeg (CA)

( * ) Notice: Subject to any disclaimer, the term of this patent is extended or adjusted under 35 U.S.C. 154(b) by 959 days.

(21) Appl. No.: 11/056,386

(22) Filed: Feb. 11, 2005

(65) Prior Publication Data

US 2006/0080890 A1 Apr. 20, 2006

Related U.S. Application Data

(60) Provisional application No. 60/620,530, filed on Oct. 20, 2004.

(51) Int. Cl.
*F24F 13/06* (2006.01)
*E06B 9/01* (2006.01)

(52) U.S. Cl. ..... 454/270; 454/48; 454/271; 454/276; 454/277; 49/50; 52/473

(58) Field of Classification Search ..... 454/48, 454/243, 245, 270, 271, 277, 281, 276; 109/1 V; 49/50; 52/473
See application file for complete search history.

(56) References Cited

U.S. PATENT DOCUMENTS

| | | | | |
|---|---|---|---|---|
| 68,076 | A | 8/1867 | Hoffman | |
| 637,519 | A | 11/1899 | Mertins | |
| 1,093,415 | A * | 4/1914 | Himes | 454/222 |
| 1,400,860 | A | 12/1921 | Brown | |
| 1,442,588 | A | 1/1923 | Tompkins | |
| 1,650,569 | A | 11/1927 | Nickle | |
| 1,673,906 | A | 6/1928 | Fager | |
| 1,703,437 | A | 2/1929 | Wills | |
| 2,075,258 | A | 3/1937 | Anderson | |
| 2,209,121 | A | 7/1940 | Honerkamp | |
| 2,339,629 | A | 1/1944 | Fischer, Jr. | |

(Continued)

FOREIGN PATENT DOCUMENTS

DE 3131223 A1 * 2/1983

(Continued)

OTHER PUBLICATIONS

"Product Specifications and Submittal Sheets for S-Vent," http://www.anemostat.com/AirSecurity/index.html, Anemostat Products, Carson, California.

(Continued)

*Primary Examiner*—Steven B McAllister
*Assistant Examiner*—Patrick F. O'Reilly, III
(74) *Attorney, Agent, or Firm*—Smith, Gambrell & Russell

(57) ABSTRACT

A security grill for a security institution has an air inlet face, an air outlet face, and zigzag channels extending from a point adjacent the inlet face toward the outlet face. The zigzag channels are defined by slats which are bent at least twice in alternating directions. The zigzag channels are divided into segments each having a cross-sectional width. The segments adjacent the air outlet face have a cross-sectional width less than any of the other segments along the channel. The slats are bent at certain angles which are larger than those of conventional security grills. Corners are created along each slat as a result of bending the slats in alternating directions. The corners are rounded.

24 Claims, 2 Drawing Sheets

U.S. PATENT DOCUMENTS

| | | | | | |
|---|---|---|---|---|---|
| 2,354,466 | A | | 7/1944 | Levinsen | |
| 2,376,331 | A | * | 5/1945 | Abrams | 89/36.08 |
| 2,477,619 | A | | 8/1949 | Kennedy | |
| 2,705,449 | A | * | 4/1955 | Clarke | 49/53 |
| 2,790,376 | A | | 4/1957 | Kennedy et al. | |
| 2,848,936 | A | | 8/1958 | Vallero | |
| 2,925,457 | A | * | 2/1960 | Lindgren | 174/383 |
| 2,996,972 | A | | 8/1961 | Johansson | |
| 3,122,087 | A | | 2/1964 | Demuth et al. | |
| 3,124,903 | A | | 3/1964 | Truhan | |
| 3,125,196 | A | | 3/1964 | Fenner | |
| 3,285,156 | A | * | 11/1966 | Bohanon | 454/277 |
| 3,409,274 | A | | 11/1968 | Lawton | |
| 3,502,016 | A | | 3/1970 | Steele | |
| 3,628,442 | A | * | 12/1971 | Nijhuis | 454/277 |
| 3,660,956 | A | * | 5/1972 | Budlong | 52/669 |
| 3,929,285 | A | | 12/1975 | Daugherty, Jr. | |
| 3,946,647 | A | | 3/1976 | Lärkfeldt | |
| 4,084,616 | A | | 4/1978 | Tragert | |
| 4,189,990 | A | | 2/1980 | Kittler | |
| 4,325,283 | A | * | 4/1982 | Bemiss | 89/36.07 |
| 4,417,687 | A | | 11/1983 | Grant | |
| 4,512,241 | A | | 4/1985 | Morris et al. | |
| 4,657,178 | A | | 4/1987 | Meckler | |
| 4,911,066 | A | | 3/1990 | Carew | |
| 4,936,400 | A | * | 6/1990 | Blumbach et al. | 180/68.1 |
| 4,957,034 | A | * | 9/1990 | Tasdemiroglu | 89/36.02 |
| 5,099,754 | A | | 3/1992 | Griepentrog | |
| 5,135,436 | A | | 8/1992 | Levy et al. | |
| 5,238,451 | A | * | 8/1993 | Wulf et al. | 454/282 |
| 5,238,452 | A | | 8/1993 | Levy et al. | |
| 5,304,094 | A | | 4/1994 | MacCracken | |
| 5,338,254 | A | | 8/1994 | Farrington | |
| 5,344,364 | A | | 9/1994 | Michlovic | |
| 5,358,444 | A | | 10/1994 | Helm et al. | |
| 5,375,373 | A | | 12/1994 | Tiede | |
| 5,403,232 | A | | 4/1995 | Helm et al. | |
| 5,607,354 | A | | 3/1997 | Mill et al. | |
| 5,780,761 | A | * | 7/1998 | Musante et al. | 89/36.08 |
| 5,803,212 | A | * | 9/1998 | Reinehr et al. | 188/372 |
| 6,019,677 | A | | 2/2000 | Demster | |
| 6,113,488 | A | | 9/2000 | Tiede | |
| 6,405,630 | B1 | * | 6/2002 | Gonzalez | 89/36.02 |
| 6,672,195 | B1 | * | 1/2004 | Plattner | 89/36.11 |

FOREIGN PATENT DOCUMENTS

| | | | | |
|---|---|---|---|---|
| DE | 34 17 002 | A1 | | 11/1985 |
| DE | 43 01 757 | C1 | | 5/1994 |
| EP | 0 607 116 | A1 | | 7/1994 |
| EP | 1 621 451 | A2 | | 10/1994 |
| EP | 821205 | A2 | * | 1/1998 |
| JP | 61-165537 | | | 4/1986 |
| RU | 566079 | | | 7/1977 |

OTHER PUBLICATIONS

"Components Catalogue:Air-Distribution Management and Air-Conditioning Components and Systems," http://www.krantz.de, Krantz Komponenten, Aachen, Germany.

* cited by examiner

AIR CHANNEL GRILL FOR SECURITY INSTITUTIONS

RELATED APPLICATION

This application claims the benefit of priority of U.S. provisional application Ser. No. 60/620,530, filed Oct. 20, 2004, which is relied on and incorporated herein by reference.

FIELD OF THE INVENTION

The present invention relates generally to an improved air channel grill for security institutions. More particularly, the present invention relates to an air channel grill having design features that improve air delivery performance and efficiency without compromising the security requirements of the air grills for security institutions.

BACKGROUND OF THE INVENTION

The term "air grill" is used in reference to gratings used to cover openings in the ventilation system for the purpose of supplying or exhausting air to or from a given space.

The term "security institution" is used in reference to correctional facilities, penal facilities, mental health facilities and/or any other type of facility where the persons under the care of such facility are purposely and/or lawfully isolated from the public.

Air grills used in security applications must perform above and beyond the standard inlet/outlet air grills. Specifically, such a security grill must be incapable of being disassembled to create weapons or tools, the security grill must restrict access to the ductwork beyond the grill to prevent storage of contraband material, the security grill must prevent escape or entry into the ductwork, and the security grill must virtually eliminate the occupant's ability to thread items into the air channels or passages of the diffuser for the purpose of suicide attempts.

Conventional security grills for security institutions that meet the above mentioned requirements generally comprise a body having two opposed faces, where at least one passage extends through the body between the opposed faces creating an air channel. The passageway (air channel) has at least one change in direction creating a so-called "zigzag pattern." FIG. 1 illustrates such a conventional security grill.

The prior art security grill shown in FIG. 1 consists of a body 10 having two opposed faces 11 and 12, and a number of channels 13 extending through the body between the opposed faces. Each channel 13 has at least one change in direction defining a zigzag pattern. The zigzag pattern of each channel forms segments S1, S2, S3, and S4 which have a rectangular cross-sectional shape. The problem with conventional security grill designs is the notion that very little can be done to improve the air delivery performance and efficiency of the security grill without compromising the requirements of the air grills for security institutions as stated above.

What is required is an air grill for security institutions that would provide the security institutions with a more efficient and cost effective method of ventilating space without compromising the safety of the occupants.

SUMMARY OF THE INVENTION

According to the present invention, an air grill for security institutions comprises two opposing faces, with passages or channels extending between the faces in a zigzag course. The channels are elongated zigzag slots consisting of segments.

The zigzag slots formed by the segments have a rectangular cross-sectional shape. The channels are defined by slats that are bent at least twice in alternating directions.

The first segment of each zigzag channel adjacent the air outlet has a smaller cross-sectional width than any of the other segments. This is done in order to limit the size of the slot at the air outlet, and therefore restrict the size and shape of the objects that could be possibly inserted in the slot. The following segments of each zigzag channel have at least one segment with an enlarged cross-sectional width. Increasing the cross-sectional width of at least one segment creates an area through which the air can move more freely, therefore reducing static pressure drop across that segment. Because the grill for security institutions can be comprised of more than one segment with an enlarged cross-sectional width, even more significant reductions in static pressure drop can be realized. Any reduction in static pressure drop across the entire grill improves efficiency of the ventilation system and therefore can reduce annual operating costs for ventilating systems in security institutions.

The slats are bent at certain angles which are larger than those of conventional security grills. Increasing the angle at which the slats are bent reduces the build-up of air molecules as they change direction while traveling through the zigzag channels. Therefore the static pressure drop across the security grill is reduced and the efficiency of the ventilation system is improved.

Corners are created along each slat as a result of bending the slats in alternating directions. In accordance with the present invention, the corners are rounded. By eliminating the sharp corner which exists in conventional security grill designs, the build-up of air molecules that travel through the channels is reduced and the efficiency of the system is improved.

Therefore, it is an object of the present invention to provide a security grill with zigzag channels having the segment of each channel adjacent the outlet with reduced cross-sectional area compared to segments upstream from the outlet.

Another object of the present invention is to provide a security grill with slats that are bent at larger angles to improve air flow through the zigzag channels.

Yet another object of the present invention is to provide a security grill where the corners created along the slats are rounded to improve air flow through the zigzag channels.

Further objects, features and advantages will become apparent upon consideration of the following detailed description of the invention when taken in conjunction with the drawings and the appended claims.

DETAILED DESCRIPTION OF THE PREFERRED EMBODIMENT

Figure 2:
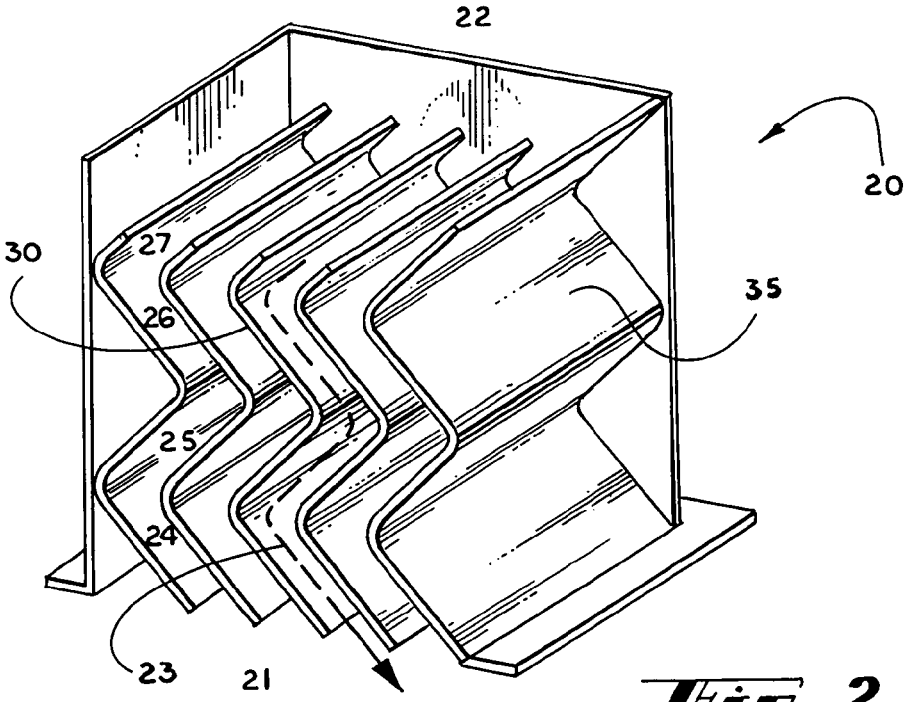
FIG. 2 is a cross-sectional perspective view of a security grill in accordance with the present invention.
Figure 3:
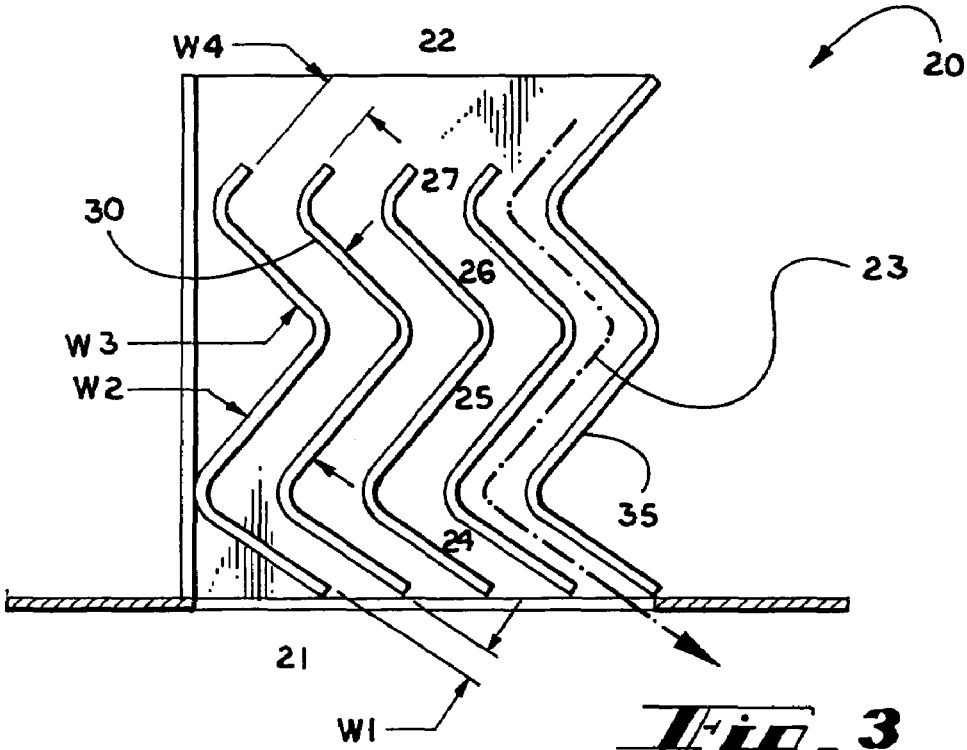
FIG. 3 is a cross-sectional side view of a security grill in accordance with the present invention.

With reference to FIGS. 2 and 3, a security grill 20 in accordance with the present invention is illustrated. The grill 20 comprises two opposing faces 21 and 22. The first face 21 comprises an air outlet, and the second face 22 comprises an air inlet. Multiple channels 23 extending from a point adjacent the first face 21 toward the second face 22 have at least two changes in direction forming a zigzag pattern. The channels 23 are elongated zigzag slots consisting of segments 24, 25, 26, and, in the described embodiment the channels have three changes in direction. The slots formed by the segments 24, 25, 26, and 27 have a rectangular cross-sectional shape. Multiple slats 30 are used to define the zigzag channels 23. Each slat 30 extends from a point adjacent the first face 21 toward the second face 22 and is bent at least twice in alternating directions. It will be appreciated that the slats 30 may, but need not, extend exactly from the first face 21 and/or exactly to the second face 22. In the described embodiment, at least one slat extends from the first face 21 to the second face 22 and defines an exterior wall 35, thereby reducing the cost of materials needed to construct the grill 20. The slats 30 may be constructed of aluminum, steel, or any other conformable material.

With reference to FIG. 3, each segment 24, 25, 26, and 27 of each channel 23 has a cross-sectional width W1, W2, W3, and W4. In one embodiment of the present invention, for each channel 23, the cross-sectional width W2, W3, and W4 of each segment 25, 26, and 27 upstream from the segment 24 adjacent the air outlet 21 is larger than the cross-sectional width W1 of the outlet segment 24. Particularly, the first segment 24 of each zigzag channel 23 at the air outlet 21 has the smallest cross-sectional width W1. The segments 25, 26, and 27, formed along the zigzag channels 23 upstream from the segment 24 nearest the air outlet 21, have at least one segment with an enlarged cross-sectional width.

In the described embodiment, the cross-sectional width W1 of the segment 24 adjacent the air outlet 21 is about 0.340 inches. In order to fit inside different sized ventilation ducts, the security grill 20 of the present invention may be constructed of various sizes, e.g., (in inches) 6×6, 9×9, 12×12, 15×15, or 18×18. Because each size grill 20 will require a different number of slats 30 to be appropriately spaced within the grill 20 for defining the air channels 23, it will be appreciated that the cross-sectional width W1 of the air outlet segment 21 may vary accordingly.

Figure 4:
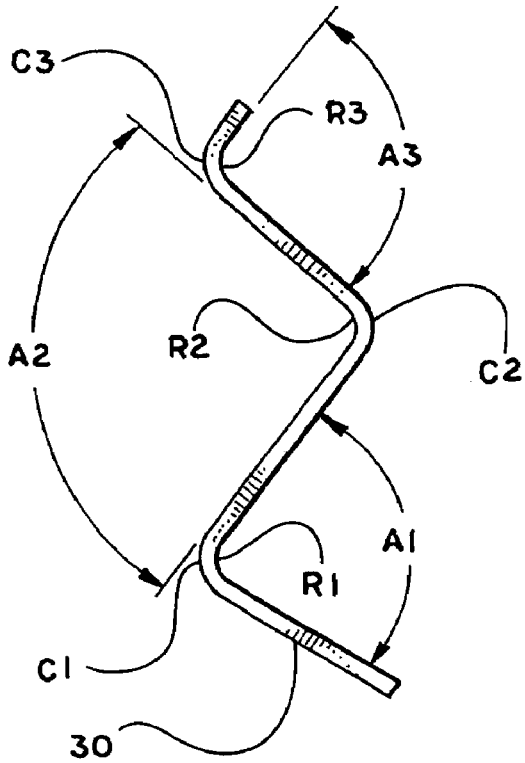
FIG. 4 is a side view of a slat for a security grill in accordance with the present invention.

As shown in FIG. 4, each slat 30 is bent at least twice in alternating directions. Each bend of each slat 30 forms an angle A1, A2, and, in the described embodiment wherein the slats are bent three times, A3. The angles A1, A2, and A3 are larger than those of conventional air grills and may be between about 84 degrees and about 100 degrees. In the described embodiment, the first angle A1 is about 85 degrees, the second angle A2 is about 95 degrees, and the third angle A3 is about 93 degrees. In another embodiment, the first angle A1, the second angle A2, and the third angle A3 are each about 84 degrees. Because each size grill 20 will require a different number of slats 30 to be appropriately spaced within the grill 20 between the opposing faces 21 and 22, it will be appreciated that the size of the angles A1, A2, and/or A3 may vary accordingly.

Each bend of each slat 30 also forms corner C1, C2, and C3, in the described embodiment wherein the slats are bent three times. The corners C1, C2, and, C3 are rounded as opposed to being sharp, and thereby have radii, R1, R2, and R3, respectively. The radii R1, R2, and R3 may be between about 0.093 inches and about 0.2 inches. In the described embodiment, the first radius R1, the second radius R2, and the third radius R3, are each about 0.2 inches. Because each size grill 20 will require a different number of slats 30 to be appropriately spaced within the grill 20 between the opposing faces 21 and 22, it will be appreciated that the size of the radii R1, R2, and/or R3 may vary accordingly.

With reference to FIGS. 3 and 4, the operation of a grille grill 20 in accordance with the present invention will now be described.

The cross-sectional width W1 of the air outlet segment 24 is kept at a minimum to restrict the size and shape of the objects that could be possibly inserted in the slot.

Increasing the cross-sectional width of at least one segment 25, 26, or 27, upstream from the outlet segment 24, creates an area with greater wall separation through which the air can move more freely in comparison to the outlet segment 24, therefore reducing static pressure drop across that segment 25, 26, or 27. Because the grill 20 for security institutions can be comprised of more than one segment with enlarged cross-sectional width, even more significant reductions in static pressure drop can be realized. Any reduction in static pressure drop across the entire grill 20 improves efficiency of the ventilation system and therefore can reduce annual operating costs for ventilating systems in security institutions.

Increasing the angles A1, A2, and A3 at which the slats 30 are bent creates a more gradual change in direction through which air molecules must travel when passing through the channels 23 of the grill 20. A more gradual change in direction reduces the build-up of air molecules at each turn and allows the molecules to flow more quickly and freely through the grill 20. Therefore the static pressure drop across the security grill 20 is reduced, and the efficiency of the ventilation system is improved. By limiting the size of the angles to an appropriate maximum, the security requirements of the grill 20 are not compromised as occupants remain unable to thread items through the air channels 23.

Rounding the corners C1, C2, and C3 along each slat 30 creates more space for air molecules to pass through as they change direction through the channels 23 and results in less build-up of air molecules. Thus, the static pressure drop across the security grill 20 is reduced and the efficiency of the ventilation system is improved. By limiting the size of the radii to an appropriate maximum, the security requirements of the grill 20 are not compromised as occupants remain unable to thread items through the air channels 23.

Accordingly, by using a grill 20 in accordance with the present invention, one can derive significant air delivery performance improvements and therefore reduce annual operating costs of the ventilation system without compromising the security requirements of the grill 20 for security institutions.

Figure 1:
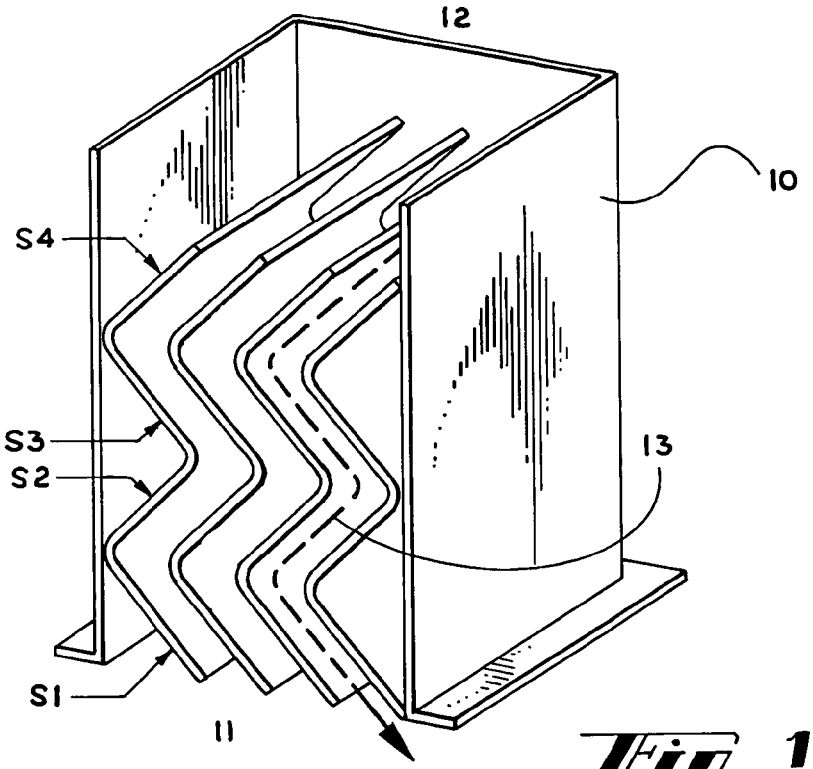
Fig. 1 PRIOR ART
FIG. 1 is a cross-sectional perspective view of the prior art security grill.

With reference to Tables 1, 2, 3, and 4, the air delivery performance improvements of the present invention over the prior art (FIG. 1) with sharp corners and sharp bend angles will be described.

TABLE 1

| | | | Prior Art. | | | | | | |
|---|---|---|---|---|---|---|---|---|---|
| | | | Octave Band, PWL | | | | | | |
| Run No. | CFM | ISP | 2 | 3 | 4 | 5 | 6 | 7 | NC |
| 10 | 238 | 0.359 | 51.4 | 50.7 | 47.4 | 46.5 | 40.3 | 31.1 | 35 |
| 11 | 271 | 0.435 | 52.0 | 52.5 | 50.5 | 49.5 | 43.6 | 36.0 | 38 |
| 12 | 306 | 0.546 | 54.1 | 55.0 | 53.7 | 52.7 | 47.6 | 41.5 | 41 |
| 13 | 342 | 0.657 | 55.1 | 56.7 | 55.9 | 55.4 | 50.4 | 45.5 | 44 |

TABLE 2

| The Present Invention. | | | | | | | | | |
|---|---|---|---|---|---|---|---|---|---|
| | | | Octave Band, PWL | | | | | | |
| Run No. | CFM | ISP | 2 | 3 | 4 | 5 | 6 | 7 | NC |
| 1 | 241 | 0.192 | 45.3 | 38.6 | 42.1 | 44.8 | 38.5 | — | 33 |
| 2 | 270 | 0.240 | 46.8 | 41.5 | 44.2 | 47.8 | 42.2 | 30.9 | 36 |
| 3 | 305 | 0.309 | 49.3 | 43.9 | 45.7 | 50.7 | 45.9 | 35.8 | 39 |
| 4 | 342 | 0.381 | 50.7 | 46.8 | 47.6 | 53.2 | 49.2 | 39.9 | 42 |

Table 1 shows internal static pressure ("ISP") and noise level performance data which was gathered for a conventional air channel grill (FIG. 1) having sharp corners, i.e., radii of about 0.062 inches, and small angles, i.e., angles that are about 80.5 degrees to 82.5 degrees. Particularly, four testing runs were performed, Run Nos. 10, 11, 12, and 13, each at a different airflow rate, expressed in cubic feet per minute ("CFM"). For each testing run, the internal static pressure (expressed in inches of water) and the sound power level ("PWL") (expressed in decibels) in several octave bands were measured and the Noise Criteria ("NC") was calculated.

Table 2 shows internal static pressure ("ISP") and noise level performance data which was gathered for an air channel grill in accordance with an embodiment of the present invention wherein the cross-sectional width W1 of the segment 24 adjacent the air outlet 21 is about 0.340 inches, the first angle A1 is about 85 degrees, the second angle A2 is about 95 degrees, the third angle A3 is about 93 degrees, and the first radius R1, the second radius R2, and the third radius R3 are each about 0.2 inches. Specifically, four testing runs were performed, Run Nos. 1, 2, 3, and 4, each at an airflow rate corresponding to the airflow rate used for Run Nos. 10, 11, 12, and 13, respectively, for the conventional air channel grill. For each testing run, the internal static pressure (expressed in inches of water) and the sound power level ("PWL") (expressed in decibels) in several octave bands were measured and the Noise Criteria ("NC") was calculated.

A comparison of the performance data shown in Table 1 with the performance data shown in Table 2 demonstrates that constructing an air channel grill in accordance with the present invention results in significantly lower internal static pressure and level of noise than conventional air channel grills. By providing a reduction in static pressure drop across the grill, the present invention improves the efficiency of the ventilation system and therefore can reduce annual operating costs for ventilating systems in security institutions.

TABLE 3

| Prior Art. | | | |
|---|---|---|---|
| Run No. | CFM | ISP | NC |
| 1 | 174 | 0.17 | 27 |
| 2 | 193 | 0.21 | 31 |
| 3 | 220 | 0.28 | 34 |
| 4 | 238 | 0.36 | 35 |

TABLE 4

| The Present Invention. | | | |
|---|---|---|---|
| Run No. | CFM | ISP | NC |
| 5 | 173 | 0.16 | 23 |
| 6 | 197 | 0.21 | 28 |
| 7 | 222 | 0.26 | 31 |
| 8 | 247 | 0.32 | 34 |

Table 3 shows internal static pressure ("ISP") and noise level performance data which was gathered for a conventional air channel grill (FIG. 1) having sharp corners, i.e., radii of about 0.062 inches, and small angles, i.e., angles that are about 80.5 degrees to 82.5 degrees. Particularly, four testing runs were performed, Run Nos. 1, 2, 3, and 4, each at a different airflow rate, expressed in cubic feet per minute ("CFM"). For each testing run, the internal static pressure (expressed in inches of water) was measured and the Noise Criteria ("NC") was calculated.

Table 4 shows internal static pressure ("ISP") and noise level performance data which was gathered for an air channel grill in accordance with another embodiment of the present invention wherein the first angle A1, the second angle A2, and the third angle A3 are each about 84 degrees. Specifically, four testing runs were performed, Run Nos. 5, 6, 7, and 8, each at an airflow rate corresponding to the airflow rate used for Run Nos. 1, 2, 3, and 4, respectively, for the conventional air channel grill. For each testing run, the internal static pressure (expressed in inches of water) was measured and the Noise Criteria ("NC") was calculated.

A comparison of the performance data shown in Table 3 with the performance data shown in Table 4 demonstrates that constructing an air channel grill in accordance with the present invention results in significantly lower internal static pressure and level of noise than conventional air channel grills. By providing a reduction in static pressure drop across the grill, the present invention improves the efficiency of the ventilation system and therefore can reduce annual operating costs for ventilating systems in security institutions.

While this invention has been described with reference to preferred embodiments thereof, it is to be understood that variations and modifications can be affected within the spirit and scope of the invention as described herein and as described in the appended claims.

We claim:

1. A security grill comprising:

a. a first face comprising an air outlet, wherein said outlet faces the inside of a room;

b. a second face comprising an air inlet, wherein said inlet faces the inside of a duct;

c. zigzag channels defined by slats, each channel having at least three consecutive segments oriented in alternating directions, extending from a point adjacent the first face toward the second face, wherein each segment is free of hooks and protrusions, and each segment of each channel has a cross-sectional width, and wherein for each channel the cross-sectional width of the first segment adjacent the first face is less than the cross-sectional width of all successive segments extending toward the second face, and wherein each angle formed by each segment of the zigzag channels relative to the next segment is between 84 degrees and 100 degrees, and wherein the vertex of each angle is rounded, and wherein the cross-sectional width of each slat is substantially the same throughout, and wherein the angle formed by the first segment of the zigzag channel is less than the angle formed by all of the successive segments of the zigzag channel.

2. The security grill of claim 1, wherein at least one slat extends from the first face to the second face to define an exterior wall.

3. The security grill of claim 2, wherein, for each channel, the cross-sectional width of the first segment adjacent the first face is about 0.34 inches.

4. The security grill of claim 1, wherein, for each channel, the cross-sectional width of the first segment adjacent the first face is about 0.34 inches.

5. A security grill comprising:

a. a first face comprising an air outlet, wherein said outlet faces the inside of a room;

b. a second face comprising an air inlet, wherein said inlet faces the inside of a duct;

c. zigzag channels defined by slats, each channel having at least three consecutive segments oriented in alternating directions, extending from a point adjacent the first face toward the second face, wherein each segment is free of hooks and protrusions, and each segment of each channel has a cross-sectional width, and wherein for each channel the cross-sectional width of the first segment adjacent the first face is less than the cross-sectional width of all successive segments extending toward the second face, and wherein, for each zigzag channel, the angle formed by the first segment of the zigzag channel relative to the second segment of the zigzag channel is about 85 degrees, and the angle formed by the second segment of the zigzag channel relative to the third segment of the zigzag channel is about 95 degrees, wherein the vertex of each angle is rounded, and wherein the cross-sectional width of each slat is substantially the same throughout, and wherein the angle formed by the first segment of the zigzag channel is less than the angle formed by all of the successive segments of the zigzag channel.

6. The security grill of claim 5, wherein at least one slat extends from the first face to the second face to define an exterior wall.

7. The security grill of claim 6, wherein, for each channel, the cross-sectional width of the first segment adjacent the first face is about 0.34 inches.

8. The security grill of claim 5, wherein, for each channel, the cross-sectional width of the first segment adjacent the first face is about 0.34 inches.

9. A security grill comprising:

a. a first face comprising an air outlet, wherein said outlet faces the inside of a room;

b. a second face comprising an air inlet, wherein said inlet faces the inside of a duct;

c. zigzag channels defined by slats, each channel having at least three consecutive segments oriented in alternating directions, extending from a point adjacent the first face toward the second face, wherein each segment is free of hooks and protrusions, and wherein each slat is bent to form at least a first radius and a second radius to define said zigzag channels, and wherein the first radius and the second radius are each between 0.093 inches and 0.2 inches, and wherein each segment of each channel has a cross-sectional width, and wherein for each channel the cross-sectional width of the first segment adjacent the first face is less than the cross-sectional width of all successive segments extending toward the second face, and wherein each angle formed by each segment of the zigzag channels relative to the next segment is between 84 degrees and 100 degrees, wherein the vertex of each angle is rounded, and wherein the cross-sectional width of each slat is substantially the same throughout, and wherein the angle formed by the first segment of the zigzag channel is less than the angle formed by all of the successive segments of the zigzag channel.

10. The security grill of claim 9, wherein at least one slat extends from the first face to the second face to define an exterior wall.

11. The security grill of claim 10, wherein, for each channel, the cross-sectional width of the first segment adjacent the first face is about 0.34 inches.

12. The security grill of claim 9, wherein, for each channel, the cross-sectional width of the first segment adjacent the first face is about 0.34 inches.

13. A security grill comprising:

a. a first face comprising an air outlet, wherein said outlet faces the inside of a room;

b. a second face comprising an air inlet, wherein said inlet faces the inside of a duct;

c. zigzag channels defined by slats, each channel having at least three consecutive segments oriented in alternating directions, extending from a point adjacent the first face toward the second face, wherein each segment is free of hooks and protrusions, and wherein each slat is bent to form at least a first radius and a second radius to define said zigzag channels, and wherein the first radius and the second radius are each between 0.093 inches and 0.2 inches, and wherein each segment of each channel has a cross-sectional width, and wherein for each channel the cross-sectional width of the first segment adjacent the first face is less than the cross-sectional width of all successive segments extending toward the second face, and wherein, for each zigzag channel, the angle formed by the first segment of the zigzag channel relative to the second segment of the zigzag channel is about 85 degrees, and the angle formed by the second segment of the zigzag channel relative to the third segment of the zigzag channel is about 95 degrees, wherein the vertex of each angle is rounded, and wherein the angle formed by the first segment of the zigzag channel is less than the angle formed by all of the successive segments of the zigzag channel.

14. The security grill of claim 13, wherein at least one slat extends from the first face to the second face to define an exterior wall.

15. The security grill of claim 14, wherein, for each channel; the cross-sectional width of the first segment adjacent the first face is about 0.34 inches.

16. The security grill of claim 13, wherein, for each channel, the cross-sectional width of the first segment adjacent the first face is about 0.34 inches.

17. A security grill comprising:

a. a first face comprising an air outlet, wherein said outlet faces the inside of a room;

b. a second face comprising an air inlet, wherein said inlet faces the inside of a duct;

c. zigzag channels defined by slats, each channel having at least four consecutive segments oriented in alternating directions, extending from a point adjacent the first face toward the second face, wherein each segment is free of hooks and protrusions, and each segment of each channel has a cross-sectional width, and wherein for each channel the cross-sectional width of the first segment adjacent the first face is less than the cross-sectional width of all successive segments extending toward the second face, and wherein, for each zigzag channel, the angle formed by the first segment of the zigzag channel relative to the second segment of the zigzag channel is about 85 degrees, the angle formed by the second segment of the zigzag channel relative to the third segment of the zigzag channel is about 95 degrees, and the angle formed by the third segment of the zigzag channel relative to the fourth segment of the zigzag channel is about 93 degrees, wherein the vertex of each angle is rounded, and wherein the cross-sectional width of each slat is substantially the same throughout, and wherein the angle formed by the first segment of the zigzag channel is less than the angle formed by all of the successive segments of the zigzag channel.

18. The security grill of claim 17, wherein at least one slat extends from the first face to the second face to define an exterior wall.

19. The security grill of claim 18, wherein, for each channel, the cross-sectional width of the first segment adjacent the first face is about 0.34 inches.

20. The security grill of claim 17, wherein, for each channel, the cross-sectional width of the first segment adjacent the first face is about 0.34 inches.

21. A security grill comprising:

a. a first face comprising an air outlet, wherein said outlet faces the inside of a room;

b. a second face comprising an air inlet, wherein said inlet faces the inside of a duct;

c. zigzag channels defined by slats, each channel having at least four consecutive segments oriented in alternating directions, extending from a point adjacent the first face toward the second face, wherein each segment is free of hooks and protrusions, and wherein each slat is bent to form at least a first radius, a second radius, and a third radius to define said zigzag channels, and wherein the first radius, the second radius, and the third radius are each between 0.093 inches and 0.2 inches, and wherein each segment of each channel has a cross-sectional width, and wherein for each channel the cross-sectional width of the first segment adjacent the first face is less than the cross-sectional width of all successive segments extending toward the second face, and wherein, for each zigzag channel, the angle formed by the first segment of the zigzag channel relative to the second segment of the zigzag channel is about 85 degrees, the angle formed by the second segment of the zigzag channel relative to the third segment of the zigzag channel is about 95 degrees, and the angle formed by the third segment of the zigzag channel relative to the fourth segment of the zigzag channel is about 93 degrees, wherein the vertex of each angle is rounded, and wherein the angle formed by the first segment of the zigzag channel is less than the angle formed by all of the successive segments of the zigzag channel.

22. The security grill of claim 21, wherein at least one slat extends from the first face to the second face to define an exterior wall.

23. The security grill of claim 22, wherein, for each channel, the cross-sectional width of the first segment adjacent the first face is about 0.34 inches.

24. The security grill of claim 21, wherein, for each channel, the cross-sectional width of the first segment adjacent the first face is about 0.34 inches.

* * * * *